US009505039B1

(12) United States Patent
Green

(10) Patent No.: US 9,505,039 B1
(45) Date of Patent: Nov. 29, 2016

(54) TOOL FOR EXPANDING A BORE SWAB

(71) Applicant: Gunnar Keith Green, Mansfield, NJ (US)

(72) Inventor: Gunnar Keith Green, Mansfield, NJ (US)

( * ) Notice: Subject to any disclaimer, the term of this patent is extended or adjusted under 35 U.S.C. 154(b) by 230 days.

(21) Appl. No.: 14/121,199

(22) Filed: Aug. 11, 2014

(51) Int. Cl.
*B08B 9/04* (2006.01)
*B08B 1/00* (2006.01)
*F41A 29/02* (2006.01)

(52) U.S. Cl.
CPC ..... *B08B 9/04* (2013.01); *B08B 1/003* (2013.01); *F41A 29/02* (2013.01)

(58) Field of Classification Search
CPC ..... B08B 1/003; B08B 9/0436; B08B 9/04; F41A 29/02; F41A 9/02; F41A 29/00
USPC ..... 42/95
See application file for complete search history.

(56) References Cited

U.S. PATENT DOCUMENTS

| | | | | | |
|---|---|---|---|---|---|
| 139,633 | A | * | 6/1873 | Turner | F41A 29/02 15/104.19 |
| 268,004 | A | | 11/1882 | Davis | |
| 486,331 | A | * | 11/1892 | Garrison | F41A 29/02 15/104.19 |
| 566,041 | A | * | 8/1896 | Warner | F41A 29/02 15/104.19 |
| 684,981 | A | | 10/1901 | Drummond | |
| 690,393 | A | | 1/1902 | Bishop | |
| 860,180 | A | | 7/1907 | Aird | |
| 1,450,037 | A | | 3/1923 | Heiman | |
| 1,738,601 | A | * | 12/1929 | Metzger | F41A 29/02 15/104.19 |
| 1,786,520 | A | | 12/1929 | Darling | |
| 2,637,865 | A | | 5/1948 | posson | |
| 2,862,218 | A | | 11/1956 | Krone | |
| 3,064,294 | A | * | 11/1962 | Stocking | F41A 29/02 15/104.19 |
| 3,398,417 | A | * | 8/1968 | Erwin | F41A 29/02 15/104.19 |
| 4,291,477 | A | | 9/1981 | Carlton | |
| 4,547,924 | A | | 10/1985 | Brygider | |
| 4,813,169 | A | | 3/1989 | Calliebe | |
| 4,858,360 | A | | 8/1989 | Hardin | |
| 4,866,871 | A | | 9/1989 | Rivers | |
| 4,873,778 | A | | 10/1989 | Stipp | |
| 4,962,607 | A | | 10/1990 | Baldwin | |
| 5,060,336 | A | | 10/1991 | LaLonde | |
| 5,628,136 | A | | 5/1997 | Wickser | |
| 5,651,207 | A | | 7/1997 | Knight | |
| 5,657,570 | A | | 8/1997 | Sigier Emmanuel | |
| 6,378,236 | B1 | | 4/2002 | Solberg | |
| 6,981,345 | B1 | | 1/2006 | Gunn | |
| 7,481,015 | B2 | | 1/2009 | Mays | |
| 8,429,846 | B2 | | 4/2013 | Krieger | |
| 2009/0283115 | A1 | * | 11/2009 | Dentico | F41A 29/02 134/22.1 |

* cited by examiner

*Primary Examiner* — Laura C Guidotti
(74) *Attorney, Agent, or Firm* — Thomas J. Germinario

(57) ABSTRACT

The tool for expanding a bore swab is a device adaptable for uses such as cleaning, as an applicator or for polishing the inside of a bore or cavity. One embodiment of the tool allows the insertion of a swab, smaller than the bore, into a work piece and provides a means to increase the radial size of the swab as needed. This is accomplished in one embodiment by forming or placing a swab on the tool, which includes a rod with a head and a sleeve. When the sleeve is moved in an axial direction towards the head, the swab expands in radial size. Other embodiments are described and shown.

20 Claims, 4 Drawing Sheets

TOOL FOR EXPANDING A BORE SWAB

CROSS-REFERENCE TO RELATED APPLICATIONS

This application claims the benefit of provisional application Ser. No. 61/959,027, filed 2013 Aug. 12 by the present inventor.

BACKGROUND

Prior Art

The following is a tabulation of some prior art that presently appears relevant:

U.S. Patents

| Pat. No. | Issue Date | Patentee |
|---|---|---|
| 268,004 | Nov. 25, 1882 | Davis |
| 684,981 | Oct. 22, 1901 | Drummond, Layman |
| 690,393 | Jan. 07, 1902 | Bishop |
| 860,180 | Jul. 16, 1907 | Aird |
| 1,450,037 | Mar. 27, 1923 | Heiman |
| 1,786,520 | Dec. 30, 1929 | Darling |
| 2,637,865 | May 13, 1948 | Posson |
| 2,862,218 | Nov. 08, 1956 | Krone |
| 4,291,477 | Sep. 29, 1981 | Carlton |
| 4,547,924 | Oct. 22, 1985 | Brygider |
| 4,813,169 | Mar. 21, 1989 | Calliebe |
| 4,858,360 | Aug. 22, 1989 | Hardin |
| 4,866,871 | Sep. 19, 1989 | Rivers |
| 4,873,778 | Oct. 17, 1989 | Stipp |
| 4,962,607 | Oct. 16, 1990 | Baldwin |
| 5,060,336 | Oct. 29, 1991 | LaLonde |
| 5,628,136 | May 13, 1997 | Wickser |
| 5,651,207 | Jul. 29, 1997 | Knight |
| 5,657,570 | Aug. 19, 1997 | Sigier Emmanuel |
| US 6,378,236 B1 | Apr. 30, 2002 | Solberg |
| US 6,981,345 | Jan. 03, 2006 | Gunn |
| US 7,481,015 B2 | Jan. 27, 2009 | Mays |
| US 8,429,846 B2 | Apr. 30, 2013 | Krieger |

Bores and tubes, which are easiest accessed from one end and that require cleaning, polishing or the application of coatings, are common. Examples of such can be found in firearms, industrial equipment, musical instruments, food and pharmaceutical processing equipment and other places. Effective and efficient performance of these cleaning and application tasks presents challenges due to the inherent limited accessibility of the work piece.

One such example is that of a muzzleloading firearm barrel. Typically, these are addressed using a rod with a tip attached on the end. The tip is used to hold a piece of cloth called a patch or swab that fits tightly within the bore. Some of these tips are simple loops used to secure the patch, others are jags. Jags are tips, normally of a fixed diameter, slightly smaller than the bore to be cleaned. A cloth patch is placed over and around the jag, which is then held in place by friction when inserted inside the bore to be wiped. Alternatively, a fixed diameter, pliable, mop-like-swab may have been used. Other implements have been used on the end of rods such as brushes and scrapers. These have been used to loosen debris, making them easier to remove when followed by a patch or swab.

The swab or patch could be used dry or soaked with a liquid for coating the bore. The patched tip or swab would be inserted into the bore, using the rod to push it down the length and then pull it back out. The swab or patch could then be cleaned or replaced.

I have found a problem with this method; it pushes debris down the bore, leaving them at the far end when the assembly is pulled out. Once debris is at the inaccessible end it becomes increasingly difficult to remove. Repetition of this method only deposits more debris at the far end. In the case of the muzzle loading firearm, this debris reduces reliability by blocking the small hole used for ignition of the powder.

A second problem I have found is that the patch and tip assembly often become stuck within the bore. This is most common with the patch and jag combination. As the patch travels down the bore, it picks up debris. When the direction is reversed, the patch material and debris jam between the jag and bore surface being cleaned. These jams are often difficult to resolve and always increase the time required to perform the cleaning task.

Another problem I found occurs when patches or swabs are used to apply a liquid to the bore, such as a lubricant. A portion of the liquid, which is initially applied to the patch or swab, is squeezed out while the tight fitting patch or swab is compressed during insertion into the bore. This results in the loss of some of the liquid and prevents the uniform, controlled application to the far end of the bore.

Prior available implement designs are directed at maintaining fit and radial force of the patch or swab as applied to the bore or the convenient application of liquids and have not addressed the above described problems.

SUMMARY

In accordance with one embodiment a rod with an enlarged annular end about which a patch is wrapped or a tubular swab is placed over. Said rod fits within a tube that can be manipulated from the end opposite the patch or swab, in an axial direction opposite that of the rod, thus compressing the patch or swab against the enlarged annular end.

ADVANTAGES

Accordingly, several advantages of one or more aspects are as follows: a tool that allows the insertion of a patch or swab at a size smaller than the work piece bore and can be expanded at any point within, thus can be used to pull debris from the far end towards insertion point, that can increase or decrease radial force of a patch or swab upon the bore providing the ability to reduce radial force in the event of a jam or in order to control the removal of debris or application of coatings. Other advantages and features of one or more aspects will be apparent from a consideration of the drawings and following detailed description.

DRAWINGS

Figures

In the drawings, closely related figures have the same number but different alphabetical suffixes.

Figure 1:
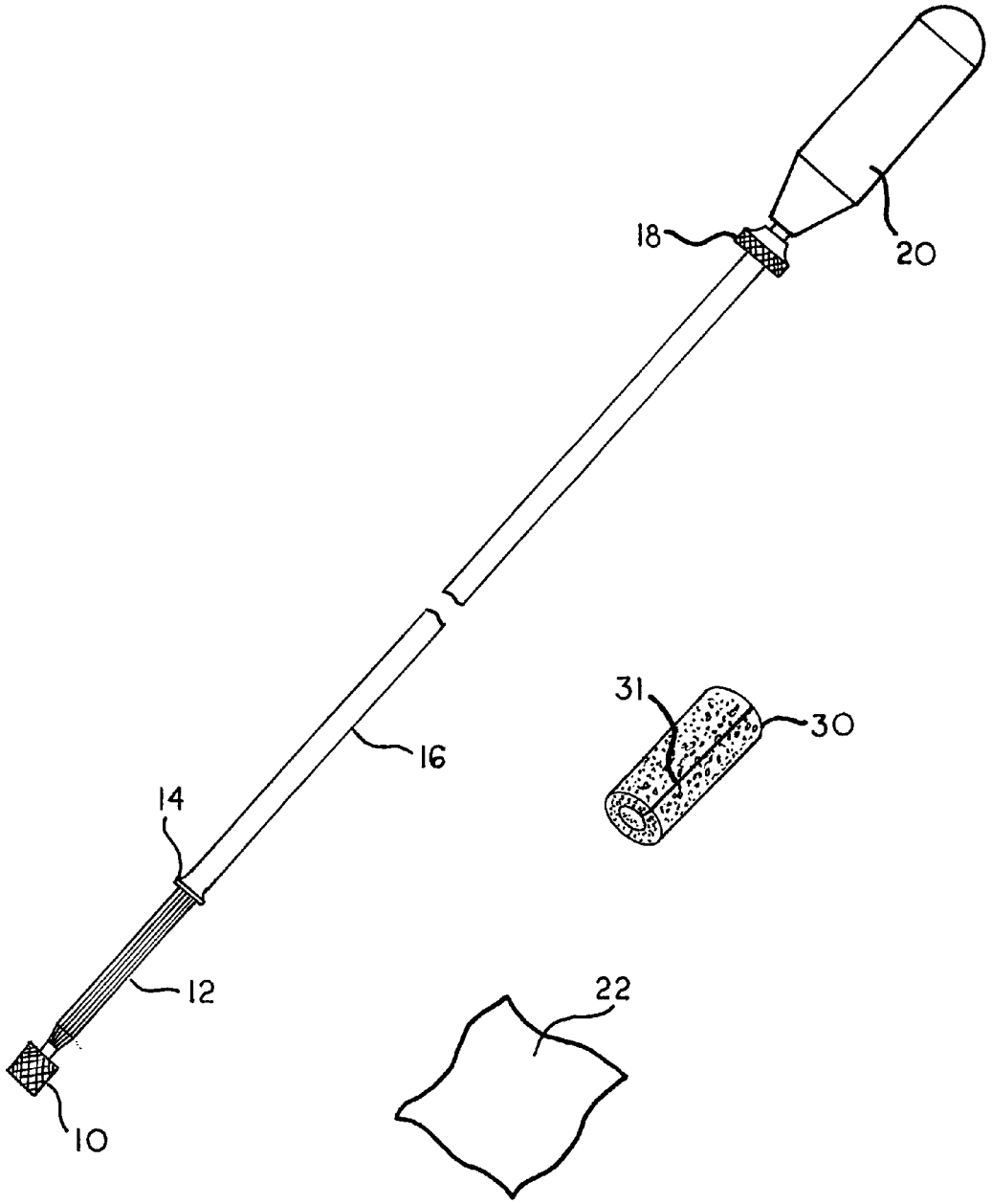
FIG. 1 is a side view of the basic components.

| Drawings - Reference Numerals | |
|---|---|
| 10 head | 12 rod |
| 14 enlarged end of sleeve | 16 sleeve |
| 18 collar | 20 handle |
| 22 patch/swab | 24 annular recess |
| 26 work piece | 28 recess/concave |
| 30 tubular swab | 31 slit |
| 32 groove | 34 snap ring |
| 36 indentation | |

DETAILED DESCRIPTION

Figure 2:
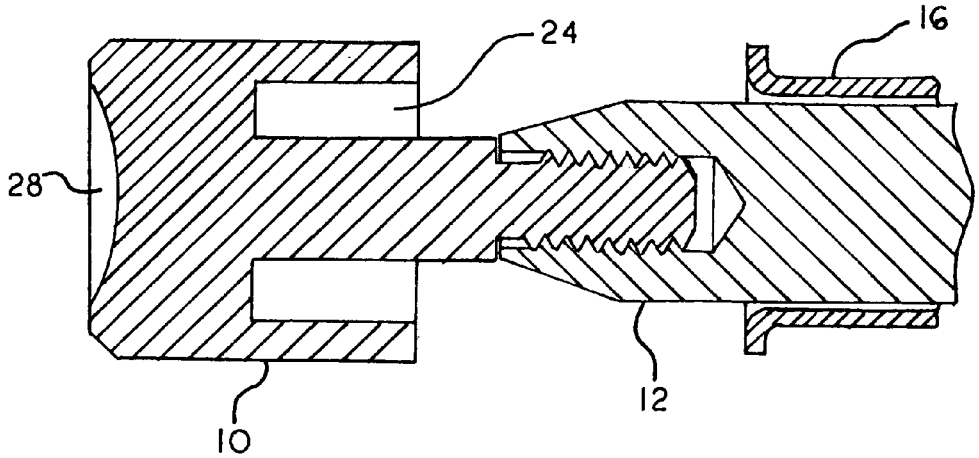
FIG. 2 is a sectioned side view of the head area of one embodiment.
Figure 3:
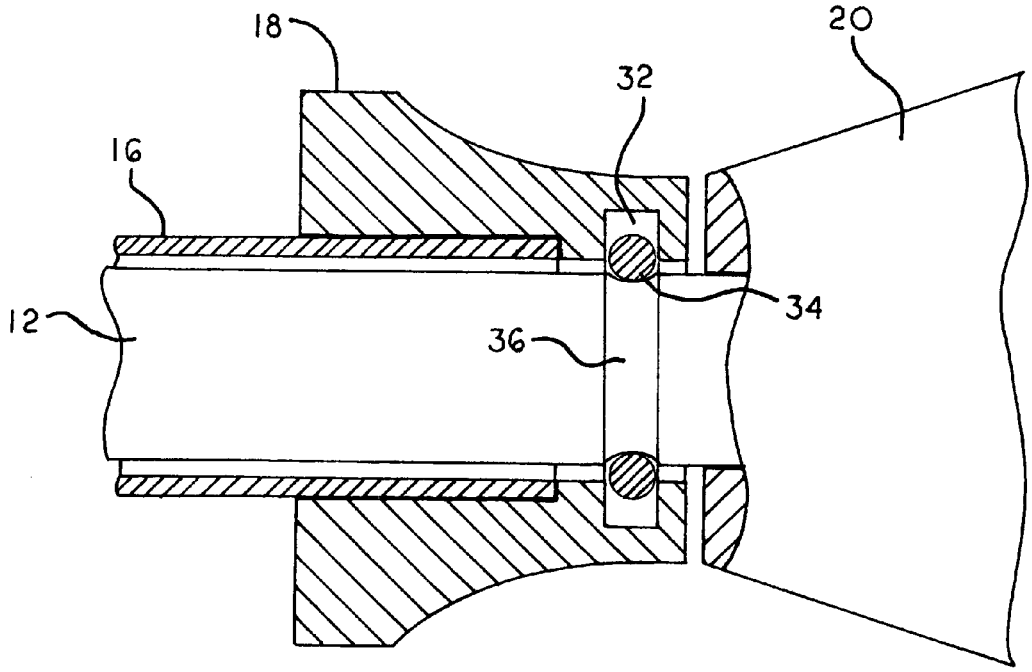
FIG. 3 is a partially sectioned view of the collar area near the handle.

FIGS. 1, 2 and 3

First Embodiment

One embodiment of the tool is illustrated in FIG. 1 (side view), FIG. 2 (sectioned view, head area) and FIG. 3 (partially sectioned view near handle). In this embodiment the parts are made of metal and/or plastic. The tool FIG. 1 has a cylindrical rod 12 of sufficient length to access the length of work piece. The rod 12 is attached to a handle 20 at one end. The rod 12 fits within a tubular sleeve 16 which is of a length shorter than the rod 12 and is enlarged at end 14. Sleeve 16 moves freely upon rod 12. The diameter and length of rod 12 and sleeve 16 are proportionate to the work piece. Attached to the sleeve 16 at the end nearest handle 20 is a collar 18 which is secure to the sleeve 16 while allowing the free movement of rod 12 through it. Collar 18 exterior surface may be textured such as with circumferential diamond knurling as shown.

The portion of rod 12 opposite handle 20, and exposed from the sleeve, has straight knurling parallel to rod axis. The rod 12 has a female thread to accept the mating thread of a cylindrical head 10. Head 10 is shown attached to rod 12 and may include exterior texturing such as circumferential diamond knurling shown. The size of the head 10 is proportionate to the work piece bore.

Also shown in FIG. 1 is a patch/swab 22 typically made of a pliable material such as woven cloth, felt or foam sheet. A tubular swab 30 is shown and which may be made of a preformed felt, foam rubber, cotton fiber or other pliable material. Tubular swab 30 may also be slit 31 along the axis through one wall cross section allowing access to inside diameter along entire axis. The size of the patch or swab is determined by the size of the work piece bore.

Patch will be a term used to describe the cut material prior to being formed into a swab. Swab will be the term used to describe a patch that has been formed about the tool or a separate type of preformed swab material such as a tubular swab 30.

Looking at FIG. 2 the sectioned view reveals an annular recess 24 in head 10. The end of rod 12 is shown tapered down providing a gradual transition between rod 12 basic diameter and the minor diameter of annular recess 24. Also revealed is a recess/concave 28 area at end of head 10. This recess/concave 28 area may be shaped differently in order to fit the object it is likely to act upon such as a conical projectile. Also seen in FIG. 2 is a portion of sleeve 16.

In FIG. 3 the sectioned view of collar 18 reveals a snap ring 34 which is captive in a groove 32. The snap ring 34 is shown positioned within a indentation 36 formed in the rod 12 (not sectioned). Also seen are the sleeve 16 and a portion of the handle 20.

OPERATION

FIGS. 4A-4D and 5A-5C

The user of the above described embodiment has multiple options as to how they use the tool. Some of these options will be described in the following.

Figure 4A:
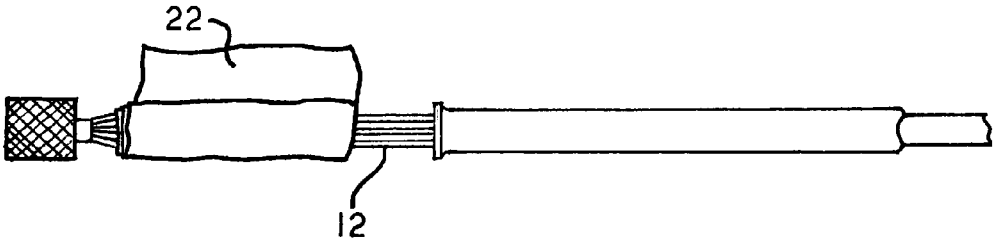
FIGS. 4A to 4D show a progression of one embodiment of the tool being used.
Figure 4B:
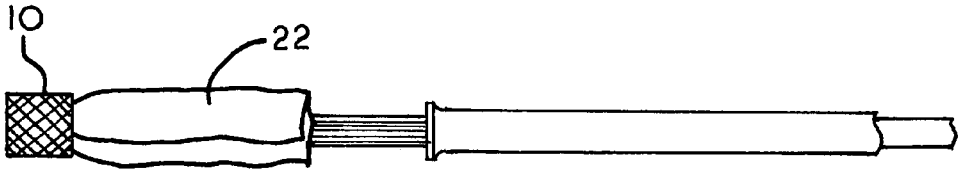
Figure 4C:
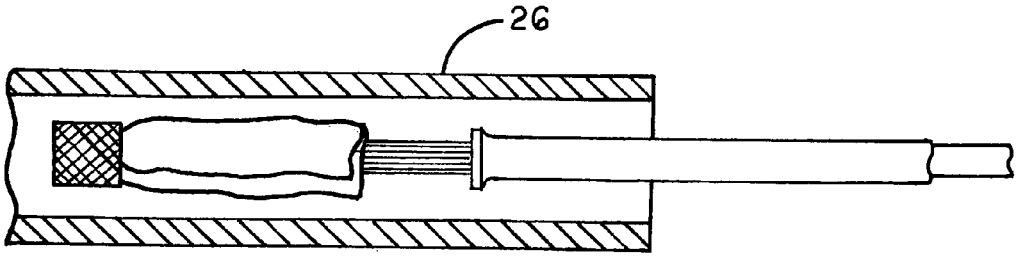
Figure 4D:
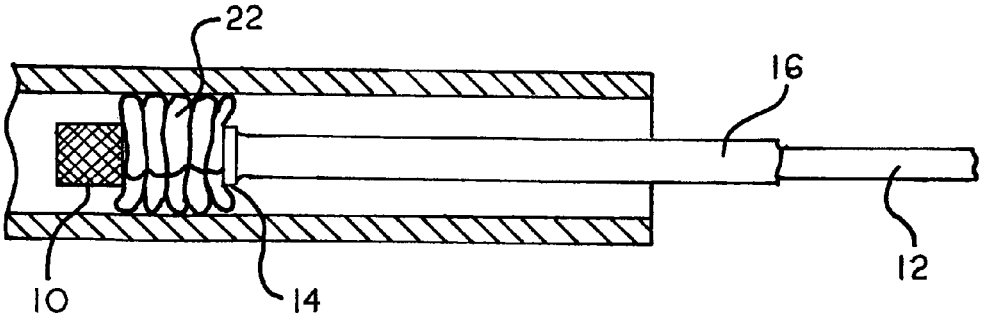

FIGS. 4A-4D show the tool being used with a patch 22 to form an undersized swab which, is inserted into the bore of a work piece 26 then expanded at the user's desired location to the desired size. In order to accomplish this, the user first wraps a patch 22 around rod 12 as seen in FIG. 3A. The straight knurling of the rod 12 assists in preventing the patch 22 from slipping while being wrapped around the rod 12. After patch 22 is completely wrapped about rod 12, it is moved towards head 10 where it is slid into the annular recess 24 (visible in FIG. 2) of head 10, thus preventing the unwrapping of patch 22. Next as seen in FIG. 4C the assembly is inserted into the work piece bore 26 to the user's desired location. Then at the handle 20 end of the tool, the user can push sleeve 16 towards head 10, typically using their thumb against collar 18 while maintaining the rod 12 static position at handle 20. The results of this action are seen in FIG. 4D wherein the enlarged end 14 of sleeve 16 has compressed the patch/swab 22 against the head 10. The result of this compression is the increased diametrical size of patch/swab 22. The user can then manipulate the assembly, to and fro, as they see fit to achieve the desired cleaning or application. Upon removal from work piece 26 the patch/swab 22 can be removed and replaced with clean, unused one.

Similar results to the above can be achieved using a preformed tubular swab 30 in place of cloth patch. To install the tubular swab 30 onto the rod 12 the head 10 can be removed swab 30 slid onto rod 12 then head 10 replaced. Alternatively, the tubular swab 30, when made from an elastic material, can be pulled over head 10 into place between head 10 and enlarged end 14 of sleeve 16 as seen FIG. 1. If a slit 31 is present along axis of tubular swab 30 it can be installed onto rod 12 between head 10 and enlarged end 14 of sleeve 16 by passing rod through slit 31 in tubular swab 30 until rod is within center of tubular swab 30. Once tubular swab 30 is in place on rod 12 the assembly can be inserted into work piece 26, expanded to a larger diameter and manipulated in the same manner as previously described using the wrapped patch/swab 22.

Figure 5A:
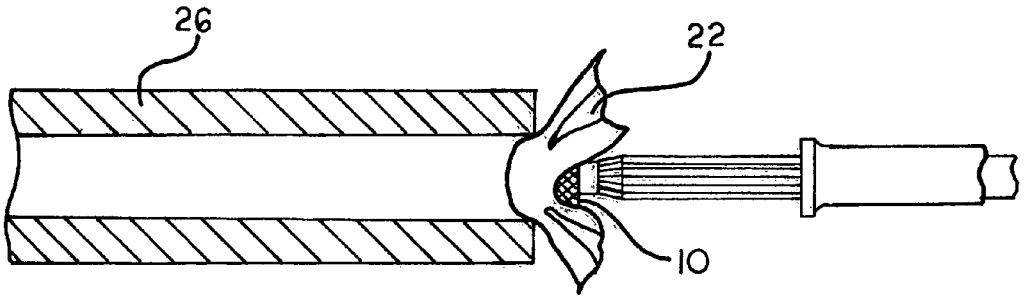
FIGS. 5A to 5C show a progression of one embodiment of the tool being used in an alternate method.
Figure 5B:
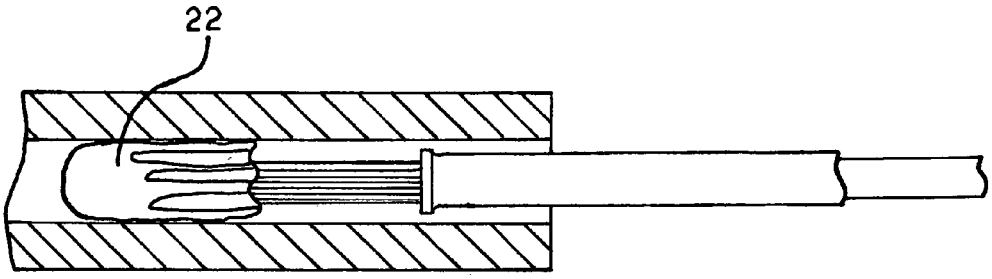
Figure 5C:
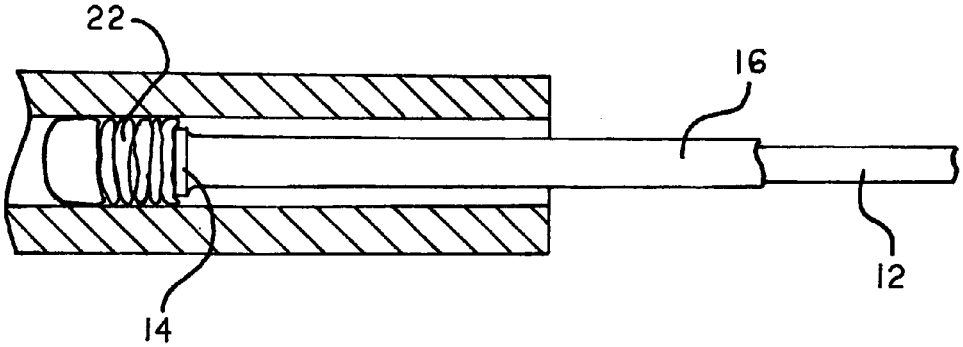

Alternatively, the same embodiment of the tool can be used as seen in FIGS. 5A-5C. The patch 22 is placed before head 10 and pushed down bore of work piece 26 and seen in FIG. 5B. If additional radial force of patch/swab 22 upon bore of work piece 26 is desired, the sleeve 16 can be manipulated towards head 10, as described above, to compress and expand patch/swab 22 as seen in FIG. 5C.

The sleeve 16 and collar 18 assembly can be kept from inadvertently moving along rod 12 by moving the collar 18 towards handle 20 until snap ring 34 enters indentation 36 in rod 12 as seen on FIG. 3.

In addition, the described embodiment can be used with other implements such as brushes, pullers and retrieval worms, commercially available which can be threaded into the end of rod 12 in place of head 10 using standard threads. Also, this embodiment can be used to push objects ahead of it, such as projectiles, using the recess/concave 28 area of head 10 as seen in FIG. 2 to maintain the assemblies centered position in respect to the item it acts upon and minimize damage thereto.

Alternative Embodiments

Some of the additions and alternatives to the above described embodiment are described in the following using nomenclature used on previously described figures for reference.

Various different materials may be used to increase compatibility and durability with work piece and substances the tool may encounter in use. The cross sections of rod 12, head 10, and sleeve 16, described as cylindrical in the above first embodiment, may be made in various sizes and shapes such as polygonal. Multiple head 10 diameters may be made to allow rod 12 effective use on multiple work piece bore sizes. The head 10 may be formed at the end of rod 12 as one homogeneous piece. The tapered portion of the rod 12 where it meets head 10 may be of different angles in order to allow patch/swab 22 to transition to annular groove 24 uninterrupted. This may included no angle or, in the case of an annular recess 24 with a minor diameter larger than the rod 12 diameter, increase to allow the gradual transition between diameters. This is with the understanding that the diameter of the annular recess 24 may be determined in part by the work piece size. The head 10 may be made without annular recess 24. The recess/concave 28 may be shaped other than concave in order to fit the object it is likely to act upon such as a conical projectile. The handle 20 may include a means to allow the rod 12 to rotate at point of attachment such as a bearing. The inclusion of handle 20 and collar 18 may be excluded. The enlarged end 14 of sleeve 16 may be of different shapes and/or sizes or excluded entirely. The head 10 may be textured, knurled, grooved or smooth on its circumferential surface. The rod 12 may be textured, knurled, grooved or smooth on its circumferential surface. The rod 12 and sleeve 16 may be mated with additional sections extending the reach of the tool. The inclusion of a taper or increasing the diameter of rod 12 from a smaller basic diameter increasing in size towards the head 10 which would force the swab to increase in diameter when sleeve 16 is moved towards the head 10 as described in the above first embodiment.

Advantages

From the description above, a number of advantages of some embodiments of my deep bore cleaning rod and applicator with expandable swab become evident:

(a) Debris can be removed from far end of work piece bore without first pushing debris towards far end of bore by inserting swab into bore with swab in its minor diameter state then, upon reaching a desired location, expanding swab allowing user to pull debris towards insertion point.

(b) The loss of liquids applied to the swab will be reduced by first inserting swab containing liquid into work piece bore in its minor diameter state then expanding swab when completely within bore minimizing loss of liquid at point of insertion.

(c) The event of a stuck or jammed swab will be reduced by allowing the user to incrementally remove debris or apply coatings.

(d) In the event a swab does become stuck or jammed, radial force of swab upon work piece can be reduced making it easier to remove.

(e) User is able to control the amount of radial force swab directs upon bore of work piece at any point. This is advantageous for number of applications including the controlled cleaning of specific areas of a work piece as well as the controlled polishing or removal of material when used with abrasives.

(f) The tool can be used to perform other tasks such as pushing a projectile down a bore like a ram rod or as a rod to affix a brush or other implement onto in order to extend the reach of the implement.

(g) The expanding swab feature makes it adjustable to bore sizes within its limits so that one tool may fit a range of work piece bore sizes.

CONCLUSION, RAMIFICATIONS, AND SCOPE

Accordingly, the reader will see that the tool for expanding a swab within a bore of various embodiments can be used in a controllable manner to clean the bore of a work piece by removing debris and coatings. It also can be used to apply coatings and polish as well as used with abrasive materials forming abrasive swabs. In addition, it can be used to push items before it as well as used as an extension for other implements. Furthermore, the tool for expanding a swab within a bore has the additional advantages in that:

- it can be produced in various lengths and diameters to better fit the intended application;
- its advantages can be realized in numerous examples of work pieces;
- it can be made using numerous types of materials resulting in compatibility with numerous work piece materials and substances it may contact during its use;
- it can be attached to and operated by an actuator or robotic device allowing for the remote operation.

While my above description contains many specificities, these should not be construed as limitations on the scope of the embodiments but merely providing examples of some of several embodiments. Many other variations are possible.

Thus the scope of the embodiments should be determined by the appended claims and their legal equivalents, rather than by the examples given.

I claim:

1. A tool for pliably engaging an interior surface of a substantially cylindrical bore having a bore diameter and a bore length, said tool comprising:

- a rigid rod, having a proximal end and a distal end, and having a rod diameter that is less than the bore diameter, and having a rod length that is greater than or equal to the bore length;
- a rigid tubular sleeve, having a proximal end and a distal end, and having a sleeve length that is less than the rod length, and having an interior sleeve diameter that is slightly greater than the rod diameter, wherein the sleeve is configured and adapted to slide freely over and axially along the rod back and forth from the proximal end of the rod to the distal end of the rod;
- a substantially cylindrical head, having a head diameter that is greater than the rod diameter and less than the bore diameter, and having a proximal face and a distal face, wherein the proximal face of the head has an axially extending first attachment means, by which the head is attached to a conjugate second attachment means axially extending from the distal end of the rod, and wherein the first attachment means is circumferentially surrounded by an annular recess in the proximal face of the head;
- a pliable swab, having a proximal edge and a distal edge, and having a swab diameter, wherein the swab wraps around or surrounds the distal end of the rod, and wherein the swab is removably attached to the head by insertion of the distal edge of the swab into the annular recess in the proximal face of the head, and wherein the proximal edge of the swab is slidably engageable by the distal end of the sleeve, whereby a distally directed sliding movement of the sleeve produces an axial compression of the swab against the head, which compression expands the swab diameter, thereby causing the swab to pliably engage the interior surface of the bore, and whereby a proximally directed sliding movement of the sleeve produces an axial elongation of the swab, which elongation contracts the swab diameter, thereby causing the swab to disengage from the interior surface of the bore.

2. The tool of claim 1, wherein the distal end of the sleeve has an enlarged, flared or flanged circumference that is slidably engageable with the proximal edge of the swab, so as to prevent the swab from overlapping the sleeve, and so as to facilitate the axial compression of the swab against the head.

3. The tool of claim 2, wherein the proximal end of the sleeve is attached to a collar, whereby the sleeve is manipulated in the distally directed sliding movement and the proximally directed sliding movement.

4. The tool of claim 3, wherein the collar contains a spring retaining ring which mates with a detent groove in the rod, so as to limit unintentional movement of the sleeve axially along the rod.

5. The tool of claim 4, wherein the proximal end of the rod is attached to a handle.

6. The tool of claim 5, wherein the first attachment means and the second attachment means comprise a mating male-female thread and socket.

7. The tool of claim 6, wherein the distal face of the head has a central concave recess, whereby the head can be centered within the bore.

8. The tool of claim 7, wherein the distal end of the rod has an outer surface containing knurling or teeth for retaining the swab.

9. The tool of claim 8, wherein the swab is tubular in shape and has an axial slit.

10. The tool of claim 9, wherein the distal end of the rod is tapered.

11. A tool for pliably engaging an interior surface of a substantially cylindrical bore having a bore diameter and a bore length, said tool comprising:

a rigid rod, having a proximal end and a distal end, and having a rod diameter that is less than the bore diameter and having a rod length that is greater than or equal to the bore length;

a rigid tubular sleeve, having a proximal end and a distal end, and having a sleeve length that is less than the rod length, and having an interior sleeve diameter that is slightly greater than the rod diameter, wherein the sleeve is configured and adapted to slide freely over and axially along the rod back and forth from the proximal end of the rod to the distal end of the rod;

a substantially cylindrical head, having a head diameter that is greater than the rod diameter and less than the bore diameter, and having a proximal face and a distal face, wherein the proximal face of the head has an axially extending first attachment means, by which the head is attached to a conjugate second attachment means axially extending from the distal end of the rod, and wherein the first attachment means is circumferentially surrounded by an annular recess in the proximal face of the head;

a pliable swab, having a proximal edge and a distal edge, and having a swab diameter, wherein the swab wraps around or surrounds the head, and wherein the proximal edge of the swab is slidably engageable by the distal end of the sleeve, whereby a distally directed sliding movement of the sleeve produces an axial compression of the swab against the head, which compression expands the swab diameter, thereby causing the swab to pliably engage the interior surface of the bore, and whereby a proximally directed sliding movement of the sleeve produces an axial elongation of the swab, which elongation contracts the swab diameter, thereby causing the swab to disengage from the interior surface of the bore.

12. The tool of claim 11, wherein the distal end of the sleeve has an enlarged, flared or flanged circumference that is slidably engageable with the proximal edge of the swab, so as to prevent the swab from overlapping the sleeve, and so as to facilitate the axial compression of the swab against the head.

13. The tool of claim 12, wherein the proximal end of the sleeve is attached to a collar, whereby the sleeve is manipulated in the distally directed sliding movement and the proximally directed sliding movement.

14. The tool of claim 13, wherein the collar contains a spring retaining ring which mates with a detent groove in the rod, so as to limit unintentional movement of the sleeve axially along the rod.

15. The tool of claim 14, wherein the proximal end of the rod is attached to a handle.

16. The tool of claim 15, wherein the first attachment means and the second attachment means comprise a mating male-female thread and socket.

17. The tool of claim 16, wherein the distal face of the head has a central concave recess, whereby the head can be centered within the bore.

18. The tool of claim 17, wherein the distal end of the rod has an outer surface containing knurling or teeth for retaining the swab.

19. The tool of claim 18, wherein the swab is tubular in shape and has an axial slit.

20. The tool of claim 19, wherein the distal end of the rod is tapered.

* * * * *